US005951258A

United States Patent [19]

Lueschow et al.

[11] Patent Number: 5,951,258

[45] Date of Patent: Sep. 14, 1999

[54] TORQUE LIMITING CONTROL SYSTEM FOR A HYDRAULIC WORK MACHINE

[75] Inventors: Kevin J. Lueschow, Edwards; Stephen V. Lunzman, Chillicothe, both of Ill.

[73] Assignee: Caterpillar Inc., Peoria, Ill.

[21] Appl. No.: 08/890,627

[22] Filed: Jul. 9, 1997

[51] Int. Cl.[6] ..... F04B 49/00

[52] U.S. Cl. ..... 417/22; 417/34

[58] Field of Search ..... 417/22, 34, 53; 60/452

[56] References Cited

U.S. PATENT DOCUMENTS

| | | | |
|---|---|---|---|
| 3,713,295 | 1/1973 | Haak et al. | 60/52 |
| 3,727,628 | 4/1973 | Habiger et al. | 137/101 |
| 3,963,378 | 6/1976 | McMillan | 417/216 |
| 4,523,892 | 6/1985 | Mitchell et al. | 417/34 |
| 4,534,707 | 8/1985 | Mitchell | 417/34 |
| 4,947,970 | 8/1990 | Miller et al. | 192/0.076 |
| 5,214,916 | 6/1993 | Lukich | 60/431 |
| 5,267,441 | 12/1993 | Devier et al. | 60/452 |
| 5,307,631 | 5/1994 | Tatsumi et al. | 60/452 |
| 5,468,126 | 11/1995 | Lukich | 417/53 |
| 5,469,646 | 11/1995 | Takamura | 37/382 |
| 5,525,043 | 6/1996 | Lukich | 417/218 |
| 5,576,962 | 11/1996 | Ferguson et al. | 364/431.03 |

*Primary Examiner*—Charles G. Freay
*Assistant Examiner*—Robert Z. Evora
*Attorney, Agent, or Firm*—David M. Masterson; Kevin M. Kercher

[57] ABSTRACT

An apparatus for controlling an electrohydraulic system of a work machine having an engine that drives a variable displacement pump is disclosed. The apparatus includes a pump displacement setting device that produces a pump command signal, a pressure sensor that detects the fluid pressure associated with the variable displacement pump and produces a pressure signal, and an engine speed sensor that detects the speed of the engine and produce an engine speed signal. A microprocessor computes the torque demand on the engine in response to the desired pump displacement, determines a torque limit associated with the engine in response to the engine speed, and responsively modifies the pump command signal to limit the engine torque.

8 Claims, 2 Drawing Sheets

TORQUE LIMITING CONTROL SYSTEM FOR A HYDRAULIC WORK MACHINE

TECHNICAL FIELD

This invention relates generally to a torque limiting control system for a hydraulic work machine and, more particularly, to a torque limiting control system for a hydraulic work machine that operates in conjunction with an underspeed engine control.

BACKGROUND ART

In the field of hydraulic work machines, for example, hydraulic excavators, variable displacement hydraulic pumps are typically driven by an engine to provide hydraulic power to a plurality of work elements which includes the drive system. Excavators, being extremely versatile machines, are useful in performing a large number of different and varied tasks, e.g., pipelaying, mass excavation, trenching, logging, etc., each task having its own unique hydraulic flow and pressure requirements. For example, during mass excavation, hydraulic power requirements are quite high with brief periods of reduced need, but in pipelaying, sustained periods of low power during waiting are common with sessions of moderate to high power.

Rudimentary control schemes have been utilized to control the engine speed of an excavator. For example, these control schemes have shown that the engine speed may be reduced to low idle during sustained periods of waiting to conserve fuel. However, these types of control schemes do not recognize controlling the engine speed during active times where less than maximum engine speed and pump flow would be required.

More sophisticated control schemes have shown that the engine speed and hydraulic pump displacement can be controlled in response to loads subjected on the work vehicle. For example, U.S. Pat. No. 4,523,892 issued to Mitchell et al. on Jun. 18, 1985, discloses an electronic control system for a hydraulic excavator which controls the engine speed and pump displacement. The control system reduces pump displacement in response to the operating speed of the engine lugging below a desired operating speed. Further, the control system reduces the engine speed in response to the operating speed of the engine rising above the desired operating speed. In this manner, the electronic control adjusts for engine lag but the electronic control does not correct the inefficiencies of the system. Thus, the electronic control improves, but does not minimize fuel consumption or eliminate undesirable engine lag.

The present invention is directed to overcoming one or more of the problems as set forth above.

DISCLOSURE OF THE INVENTION

In one aspect of the present invention, an apparatus for controlling an electrohydraulic system of a work machine having an engine that drives a variable displacement pump is disclosed. The apparatus includes a pump displacement setting device that produces a pump command signal, a pressure sensor that detects the fluid pressure associated with the variable displacement pump and produces a pressure signal, and an engine speed sensor that detects the speed of the engine and produce an engine speed signal. A microprocessor computes the torque demand on the engine in response to the desired pump displacement, determines a torque limit associated with the engine in response to the engine speed, and responsively modifies the pump command signal to limit the engine torque.

BRIEF DESCRIPTION OF THE DRAWINGS

For a better understanding of the present invention, reference may be made to the accompanying drawings in which.

BEST MODE FOR CARRYING OUT THE INVENTION

Figure 1:
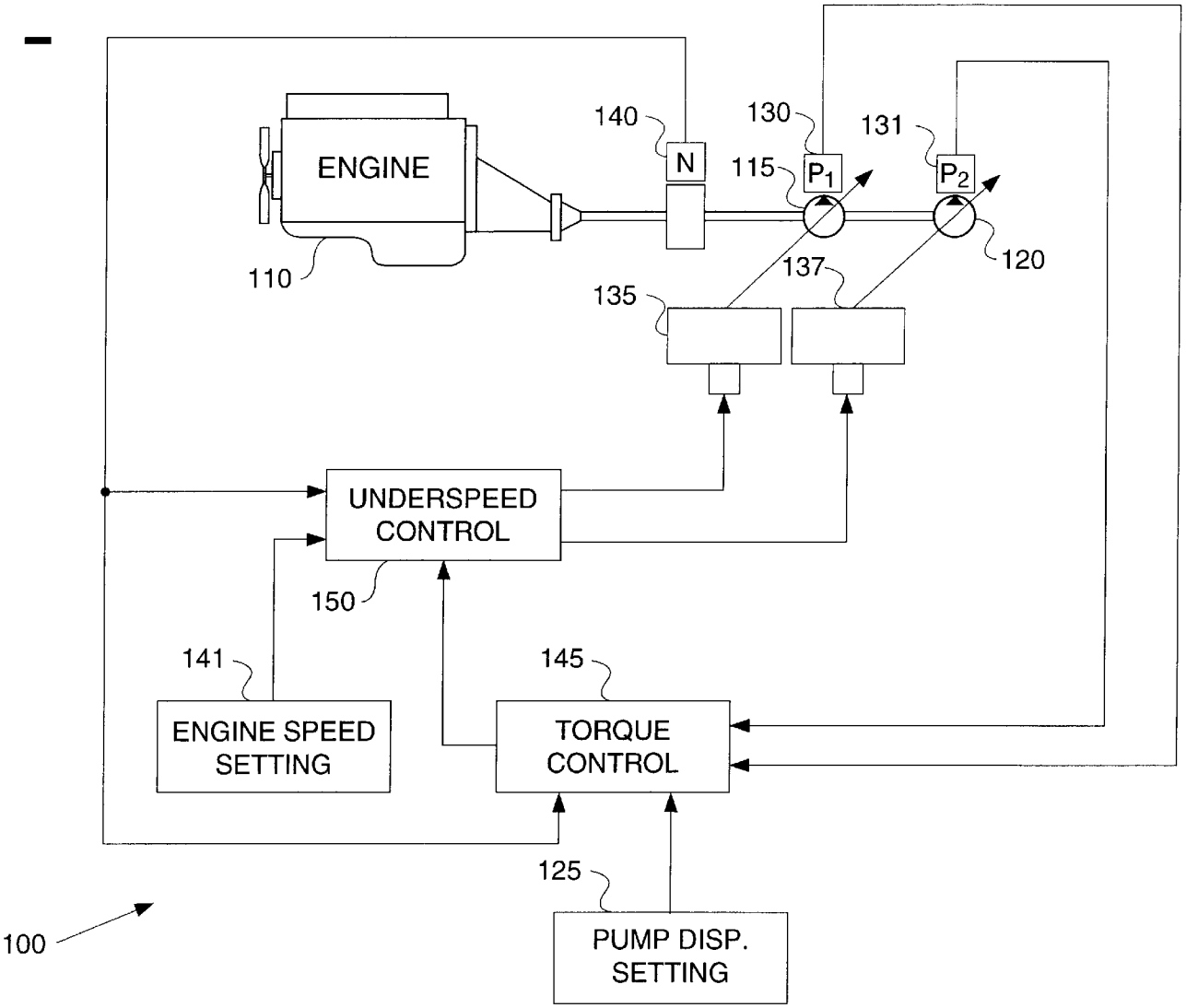
FIG. 1 illustrates a block diagram of an electrohydraulic control system for a work machine.

Reference is now made to FIG. 1 which illustrates a block diagram of an electrohydraulic control system 100 in accordance with the present invention. The electrohydraulic control system 100 is applicable to any hydrostatic controlled work machine, including an excavator. The control system 100 includes a power source such as an internal combustion engine 110, which drives one or more variable displacement pumps 115,120. The pumps 115,120 deliver fluid to a plurality of work elements (not shown). The work elements include hydraulic motors and cylinders for operating the excavator's work implement and tracks.

A pump displacement setting device 125, a.k.a., an operator control lever, produces a pump command signal indicative of a desired displacement of the variable displacement pump. The pump displacement setting device 125 preferably includes an electronic joystick. For example, the joystick produces an electronic signal having a magnitude that is indicative of a desired velocity of a work element. As is well known in the art, the electronic signal magnitude is processed via a look-up table to compute a desired pump displacement to achieve the desired velocity.

Pressure sensors 130,131 detect the fluid pressure associated with the variable displacement pumps and produce respective pressure signals indicative of the detected fluid pressure. The fluid pressure signal is additionally representative of the load on the engine. The pumps 115,120 include electronically controlled swashplates 135,137 for controlling the displacement of the pumps.

An engine speed sensor 140 detects the speed of the engine and produce an engine speed signal indicative of the actual engine speed. An engine speed setting device 141 produces an engine speed command signal indicative of a desired speed of the engine. The engine speed setting device 141 preferably includes a rotary knob for "dialing-in" the desired engine speed.

Advantageously, a torque control means 145 receives the pump pressure and engine speed signals, and reduces the magnitude of the pump command signal to decrease the anticipated load on the engine in response to the demanded engine torque.

An engine underspeed control means 150 receives the actual and desired engine speed signals, as well as, the modified pump command signal and delivers a pump control signal to the electronically controlled swashplates 135,137 to regulate the displacement of the variable displacement pumps. As is well known in the art, an underspeed controller regulates the engine speed so that the actual engine speed does not fall below the desired engine speed. Consequently, in the preferred embodiment, the underspeed control means 150 reduces the modified pump command signal, as necessary, to prevent the actual engine speed from falling below the desired engine speed.

Both the torque and underspeed control means 145,150 are microprocessor based systems which utilize arithmetic units for controlling various processes. The processes may be embodied in computer programs that are stored in read-only memory, random-access memory, or the like.

Figure 2:
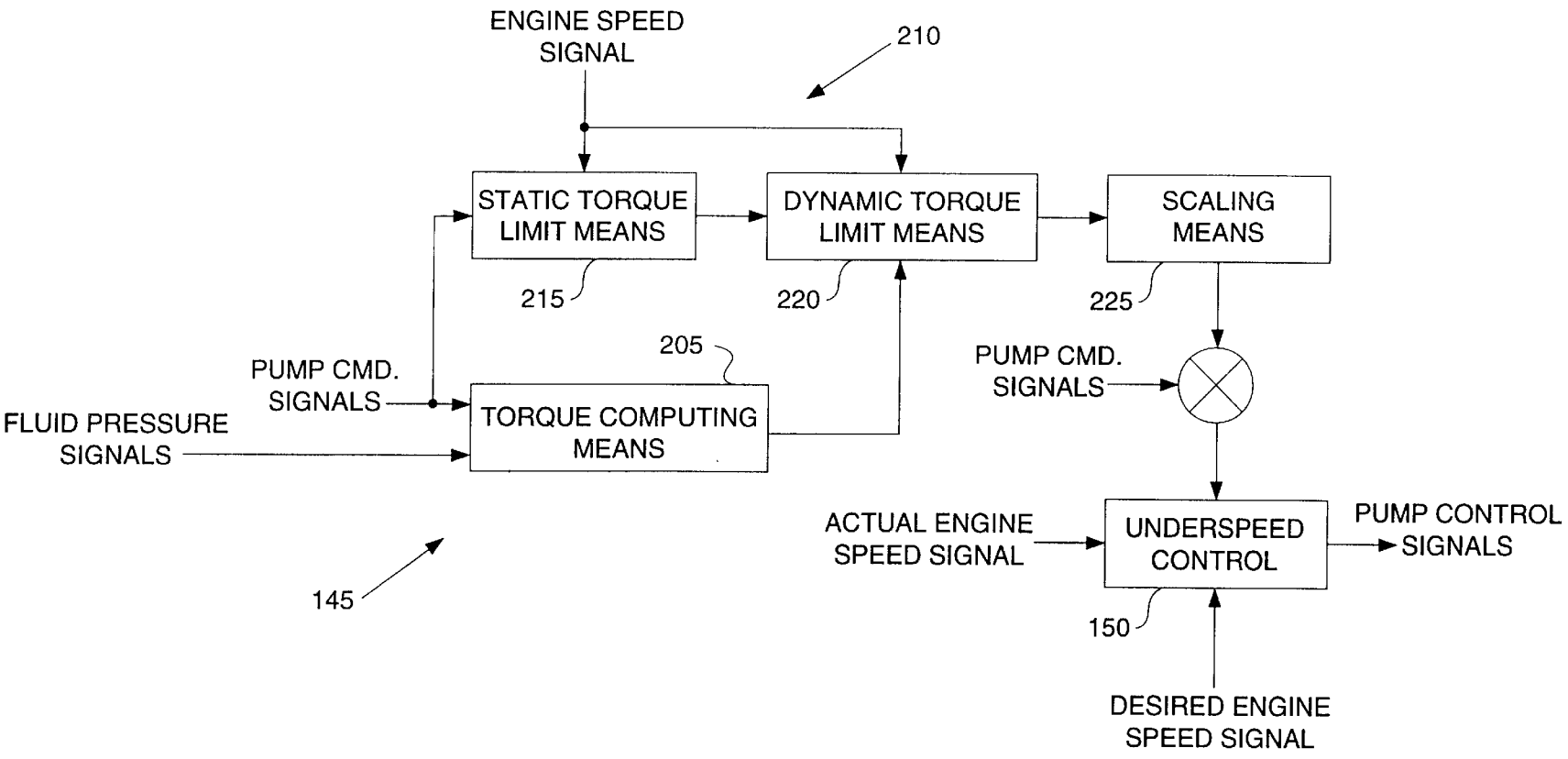
FIG. 2 illustrates a block diagram of a torque limiting control of the electrohydraulic control system.

The torque control means 145 will now be more fully explained with respect to FIG. 2. A torque computing means 205 receives the pump command and pressure signals, computes the torque demand on the engine, and responsively produces a torque demand signal. The torque may be computed as follows:

$$\text{Torque}_{demand}=\text{Displacement}_{command}*\text{Pressure}_{pump}$$

A torque limiting means 210 determines a torque limit associated with the engine and responsively produces a torque limit signal. More particularly, the torque limiting means includes a static torque limiting means 215 that receives the pump command and engine speed signals, responsively determines a static torque limit, and produces a static torque limit signal. The static torque limit represents the maximum steady-state torque available for the engine 110 based on the sensed engine speed.

The torque limiting means also includes a dynamic torque limiting means 220 that receives the torque demand and engine speed signals, responsively determines a dynamic torque limit and produces a dynamic torque limit signal. The dynamic torque limit represents the maximum rate of increase for torque load applied to the engine 110. The dynamic torque limiting means 220 additionally receives the static torque limit signal, compares the dynamic torque limit signal with the static torque limit signal, and produces a torque limit signal in response to the lessor of the dynamic and static torque limit signals.

Note, the static and dynamic torque limit may additionally be a function of other engine parameters, such as coolant temperature, boost pressure, altitude, etc. The torque limit may additionally be used by an electronic engine governor (not shown) to increase the amount of fuel delivered to the engine.

The torque limits are determined by using multi-dimentional look-up tables of a type well known in the art. The table values are based from simulation and analysis of empirical data. Alternatively, an empirical equation may readily be substituted for the look-up table if greater accuracy is desired.

A scaling means 225 receives the pump command and torque limit signals, determines a scaling factor, and scales the pump command signal in response to the scaling factor to reduce the commanded pump displacement in response to the commanded pump displacement exceeding the torque limit. For example, the scaling factor may be determined in response to the following equation:

$$\text{Scaling Factor}=\text{Torque Limit}/\text{Torque Demand}$$

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

In operation, the present invention is adapted to control the hydro-mechanical system of a work machine, e.g., an excavator. More specifically, the present invention is directed toward a torque limiting control that determines the torque demand on the engine based on the desired pump displacement and pump pressures, which are indicative of the current load on the engine. If the desired pump displacement is found to cause the engine to exceed the rated torque, then the pump command signal is reduced to an amount that causes the engine to operate at the rated torque. In this manner, the torque control of the present invention is said to be anticipatory. Therefore, the engine will be able to operate at the rated torque rating to avoid the undesired effects of engine lag. Additionally, the torque control of the present invention operates in conjunction with the underspeed control to provide for improved machine operation.

While the present invention has been described primarily in association with the hydraulic system of excavators, it is recognized that the invention can be implemented on most any engine and hydraulic pump arrangements.

Other aspects, objects and advantages of the present invention can be obtained from a study of the drawings, the disclosure and the appended claims.

We claim:

1. An apparatus for controlling an electrohydraulic system of a work machine having an engine that drives a variable displacement pump, comprising:

a pump displacement setting device adapted to produce a pump command signal indicative of a desired displacement of the variable displacement pump;

a pressure sensor adapted to detect the fluid pressure associated with the variable displacement pump and produce a pressure signal indicative of the detected fluid pressure;

an engine speed sensor adapted to detect the speed of the engine and produce an actual engine speed signal indicative of the detected engine speed;

torque computing means for receiving the pump command and pressure signals, responsively computing the torque demand on the engine and producing a torque demand signal;

torque limiting means for receiving the torque demand and engine speed signals, responsively determining a torque limit associated with the engine and producing a torque limit signal; and scaling means for receiving the pump command and torque limit signals, determining a scaling factor, and modifying the pump command signal in response to the scaling factor to govern the engine torque.

2. An apparatus, as set forth in claim 1, wherein the torque limiting means includes:

static torque limiting means for receiving the pump command and engine speed signals, responsively determining a static torque limit, and producing a static torque limit signal; and dynamic torque limiting means for receiving the torque demand and engine speed signals, responsively determining a dynamic torque limit and producing a dynamic torque limit signal.

3. An apparatus, as set forth in claim 2, wherein the dynamic torque limiting means includes means for receiving the static torque limit signal, comparing the dynamic torque limit signal with the static torque limit signal, and producing a torque limit signal in response to the lessor of the dynamic and static torque limit signals.

4. An apparatus, as set forth in claim 3, including an engine speed setting device adapted to produce an engine speed command signal indicative of a desired speed of the engine.

5. An apparatus, as set forth in claim 4, including an underspeed control means for receiving the actual and desired engine speed signals and regulating the displacement of the variable displacement pump to prevent the actual engine speed from falling below the desired engine speed.

6. An apparatus, as set forth in claim 5, wherein the underspeed control means includes means for receiving the scaled pump command and modifying the scaled pump command to prevent the actual engine speed from falling below the desired engine speed.

7. A method for controlling an electrohydraulic system of a work machine having an engine that drives a variable displacement pump, comprising the steps of:

determining a desired displacement of the variable displacement pump, and responsively producing a pump command signal;

sensing a fluid pressure associated with the variable displacement pump;

sensing the speed of the engine;

computing the torque demand on the engine in response to the desired pump displacement and responsively producing a torque demand signal;

determining a torque limit associated with the engine in response to the sensed engine speed and responsively producing a torque limit signal; and modifying the pump command signal in response to the demanded torque exceeding the torque limit.

8. A method, as set forth in claim 7, including the steps of determining a static torque limit and dynamic torque limit.

* * * * *